US005933882A

United States Patent [19]

Fleming

[11] Patent Number: 5,933,882

[45] Date of Patent: Aug. 10, 1999

[54] LEVER-ACTUATED FLUSH TOILET

[75] Inventor: David Charles Robert Fleming, Grimsby, Canada

[73] Assignee: Sanitation Equipment Limited, Concord, Canada

[21] Appl. No.: 09/090,907

[22] Filed: Jun. 5, 1998

[51] Int. Cl.[6] ..... E03D 11/10

[52] U.S. Cl. ..... 4/434; 4/435; 4/440

[58] Field of Search ..... 4/329–332, 321, 4/323, 431–442

[56] References Cited

U.S. PATENT DOCUMENTS 3,883,903 5/1975 Vanden Broek et al. ..... 4/440

3,939,501 2/1976 Sargent ..... 4/323

4,246,666 1/1981 Stansbury, Jr. ..... 4/440

4,710,988 12/1987 Stewart .

5,060,320 10/1991 Sargent et al. .

*Primary Examiner*—Charles R. Eloshway

*Attorney, Agent, or Firm*—Bereskin & Parr

[57] ABSTRACT

A flush toilet for a recreational vehicle has a flush mechanism including a lever that can be either depressed to cause a full flush of the toilet, or raised to rinse the bowl only. The lever operates a linkage that is designed so that, even after a partial failure of the linkage, the linkage can still be operated to introduce water into the bowl.

7 Claims, 5 Drawing Sheets

LEVER-ACTUATED FLUSH TOILET

FIELD OF THE INVENTION

This invention relates generally to flush toilets of the type typically used in recreational vehicles and other "occasional use" environments. It is to be understood, however, that the invention is not limited in this respect.

BACKGROUND OF THE INVENTION

A toilet for a recreational vehicle typically is assembled from a number of plastic molding, including an upper molding which defines the toilet bowl, and a lower molding or "shell" on which the bowl is supported. The bowl has a waste outlet that discharges into the shell and the shell in turn has an outlet at its lower end which is the main waste outlet from the toilet. In a recreational vehicle, the toilet is installed so that this main outlet communicates with a waste disposal conduit from the vehicle. The waste outlet from the toilet bowl is normally closed by a bowl seal which can be opened for flushing the toilet. Provision is made to deliver water into the bowl for flushing out waste, and for rinsing the surface of the bowl.

U.S. Pat. No. 4,710,988 (Stewart—assigned to Sanitation Equipment Limited) discloses a toilet of the general type discussed above. The toilet has a foot pedal actuated flush mechanism. When the pedal is depressed, flush water is delivered into the bowl and the bowl seal is opened for discharge of waste. Another example of a recreational vehicle toilet with a foot pedal flush is disclosed in U.S. Pat. No. 5,060,320 (Sargent, et al.). In that case, the toilet has separate pedals for flush water and operation of the bowl seal, but the pedals are designed to co-act so that flush water is always provided to the bowl when the bowl seal is opened.

Recreational vehicle toilets are also available with lever-operated flush mechanisms that, at least externally, appear generally similar to lever-operated flush mechanisms for normal household toilets. A consideration in designing a lever-operated flush mechanism for a recreational vehicle toilet is that the mechanism should be designed so that it is always possible for the user to rinse the bowl of the toilet, whether or not the toilet is to be fully flushed. Particularly since recreational vehicle toilets may be used only infrequently, it is desirable for the user to be able to leave the toilet in a condition in which the bowl has been rinsed, even if there has been some failure or malfunction of the lever itself.

An object of the present invention is to provide a toilet which addresses these objectives.

SUMMARY OF THE INVENTION

In its broadest aspect, the invention provides a toilet that includes a housing having a bowl for receiving waste. Closure means is provided for normally closing the bowl outlet and is operable to open the outlet for discharge of waste from the bowl. The toilet also includes water supply means operable to deliver water into the bowl and flushing means comprising an actuator pivotally mounted externally on the housing of the toilet and coupled to the bowl closure means and to the water supply means for operating the same. The actuator is turnable about a pivot axis selectively in opposite directions (a) for operating both the water supply means and the bowl closure means, and (b) for operating the water supply means only.

Preferably, the flushing means includes a pivot shaft defining the pivot axis for the actuator, the shaft extending through the housing of the toilet, for turning with the actuator. A linkage is mounted on the shaft within the housing so as to turn with the actuator, and first and second elongate operating elements extend between the linkage and the water supply means, and between the linkage and the bowl closure means, and are arranged, when placed under tension, to operate the respective said means. The linkage is adapted to place both of the operating elements under tension when the actuator is turned in direction (a) and, when the actuator is turned in direction (b), to place under tension only the operating element extending to the water supply means.

In other words, the invention provides a flushing arrangement for a recreational vehicle toilet in which an actuator such as a lever can be moved in one direction to both deliver water to the bowl and open the bowl closure, or in the other direction, to deliver water only. In whichever direction the actuator is moved, water is delivered into the bowl. This means that, short of a complete failure of the water supply, or breakage of the relevant operating element (usually a cable) it will always be possible to deliver water into the toilet bowl to at least flush the surface of the bowl, and preserve relatively sanitary conditions.

Normally, the actuator is a lever that adopts a generally horizontal orientation when at rest. The flushing means is designed so that depression of the outer end of the lever (pushing down) will cause a full flush, since this is the normal action that people are used to with domestic toilets. It will be necessary to lift the outer end of the lever merely to add water to or rinse the bowl.

Preferably, the linkage includes a primary lever element coupled to the pivot shaft within the housing of the toilet and defining a pair of lever arms that extend generally in diametrally opposite directions from the shaft. The linkage also includes a pair of links each pivotally coupled at one end to a distal region of one of the lever arms, respectively opposite ends of the links being pivotally coupled together at a common pivot point. The first elongate operating element is coupled to the common pivot point so as to be tensioned in whatever direction the actuator is turned. The second elongate element is coupled only to the relevant said lever arm so as to be placed under tension when the actuator is turned in direction (a).

The linkage may be designed so that, when the actuator is turned in direction (a), the water supply means will be operated slightly before the bowl closure means is opened, and the bowl closure means will close before the water supply is terminated.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENTS

Figure 1:
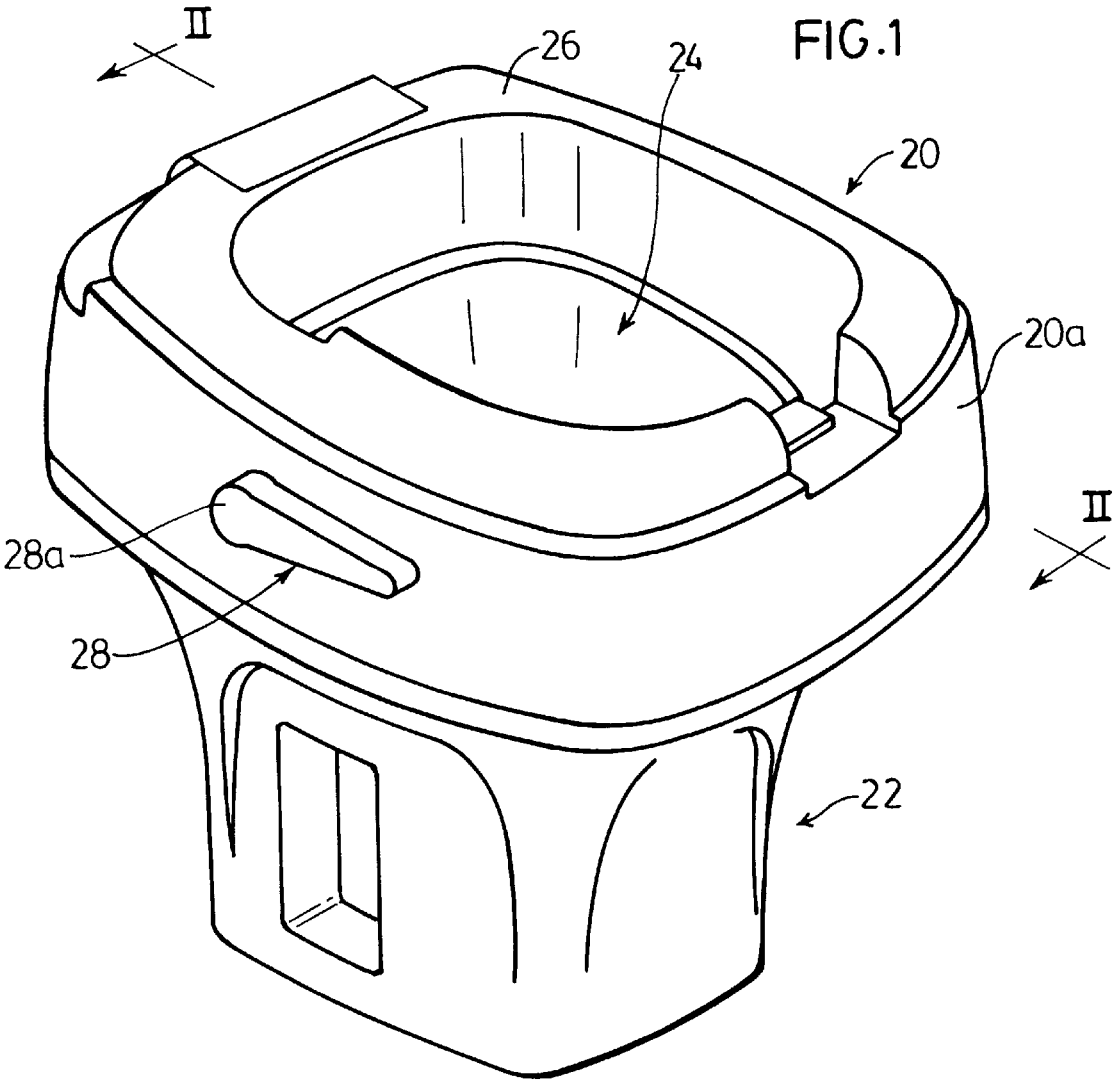
FIG.1 is a perspective view from above and to one side of a recreational vehicle toilet in accordance with the invention.

The drawings show a toilet that is generally similar to the toilet showed in the '988 (Stewart) patent referred to previously except in that the toilet shown in the drawings is lever operated instead of foot pedal operated. Otherwise, reference may be had to the Stewart patent for specific details of the toilet and its components. The disclosure of the Stewart patent is incorporated herein by reference.

As seen in FIG. 1 of the drawings of the present application, the toilet comprises upper and lower main plastic molding 20 and 22 respectively. The upper molding 20 includes a toilet bowl 24 which is surrounded at the top by a seat-like formation 26. In the finished toilet, an additional plastic molding defining an actual seat overlies formation 26 and a lid is provided above the seat; however, the lid and seat have not been shown.

Outwardly of formation 26, molding 20 includes a skirt 20*a* that in effect "sits" on the lower molding (or shell) 22. The two molding provide a housing for the toilet that includes bowl 24.

A flush lever 28 is pivotally mounted on skirt 20*a* at one side of the toilet, in a position to be conveniently accessible to a person standing in front of or seated on the toilet. Lever 28 is pivoted to the housing of the toilet (as will be described) at its rearward end 28*a*.

Figure 2:
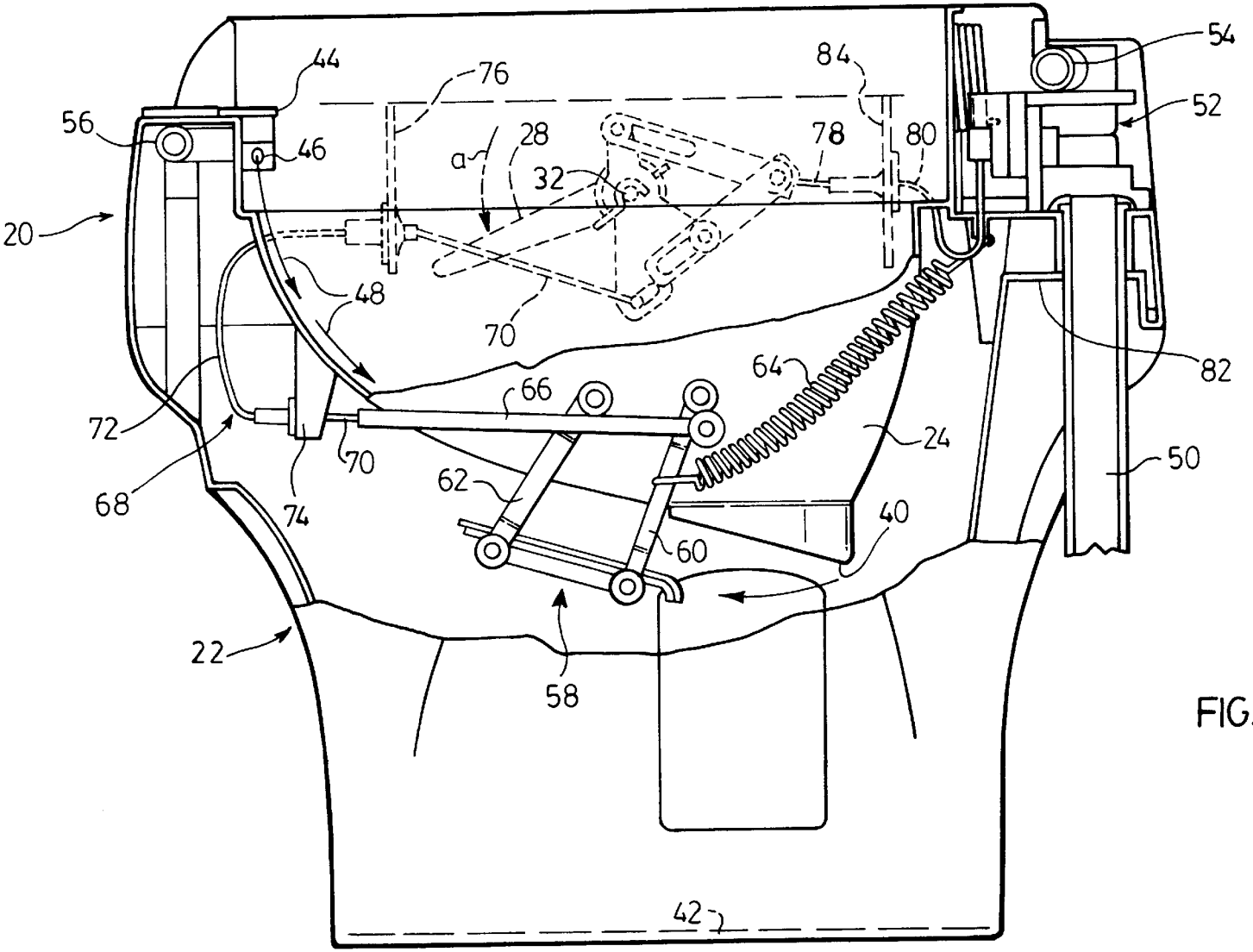
FIG. 2 is a vertical sectional view along line II—II in FIG. 1.
Figure 4:
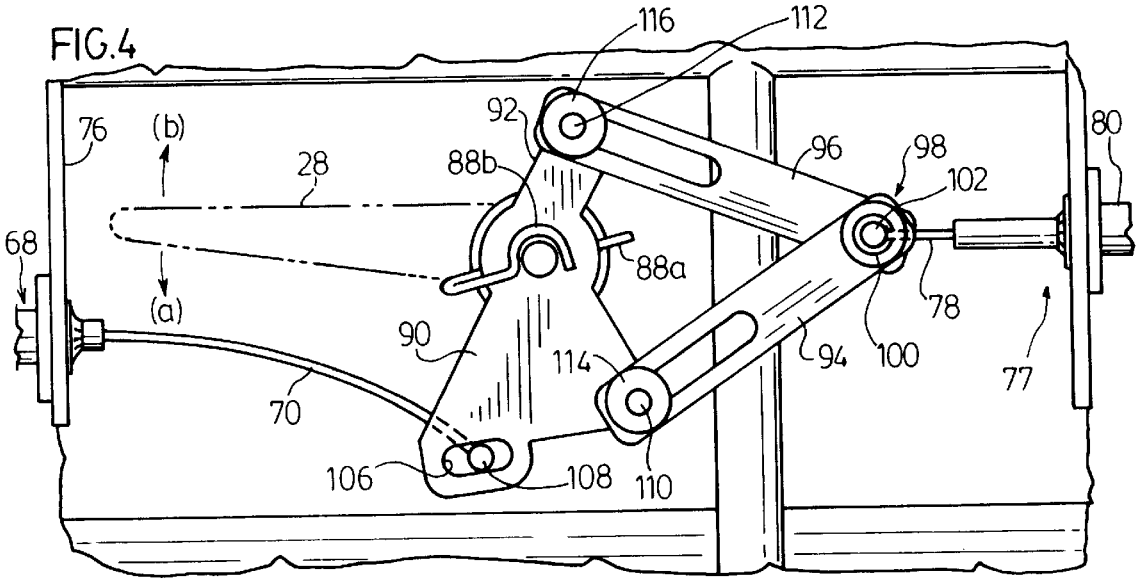
FIG. 4 is an elevational view corresponding to FIG. 3.

Referring now to FIG. 2, lever 28 is shown in dotted lines in that view, as having been rotated in the direction of arrow "a" about a pivot axis 32 from a normal horizontal rest position as shown in FIG. 4. As will be described in detail later, movement of the lever in direction (a) is effective to fully flush the toilet. Movement in the opposite direction (b) merely delivers water into bowl 24.

Axis 32 is defined by a pivot shaft 34 (see e.g. FIG. 3) that extends through the wall of the housing of the toilet and is journaled in a bush 36. Lever 28 is fixed to shaft 34 so that the shaft turns with the lever. Internally of the toilet housing, shaft 34 carries a linkage that is generally denoted 38 and that will be described in more detail later.

Reverting to FIG. 2, it will be seen that the toilet bowl 24 has an outlet 40 through which waste can pass from the bowl 24 into the interior of the shell defined by molding 22. An outlet 42 in shell 22 provides the main outlet from the toilet and normally is coupled to a waste disposal conduit in a recreational vehicle.

Bowl 24 has a rim 44 that is partly encircled by a water pipe 46 having openings through which water can be dispensed onto the interior surface of the bowl as indicated at 48. A main water supply pipe to the toilet is indicated at 50 and leads to a water control valve 52 having an outlet 54 that communicates with an inlet 56 to pipe 46.

A bowl seal for the bowl outlet 40 is shown at 58 in a position spaced laterally from bowl outlet 40. Bowl seal 58 normally lies across and closes outlet 40 but can be moved to the position in which it is shown in FIG. 2 to open the outlet and allow discharge of waste from the toilet bowl.

Bowl seal 58 is carried by two pairs of links 60, 62 that extend between the seal and the bowl 24. The other link in each pair is at the opposite side of the bowl as compared with the side that visible in FIG. 2. A tension spring 64 extends between a fixed point inside the toilet housing and one of the links 62 for normally maintaining the bowl seal in its closed position. A yoke 66 embraces the bowl and extends between the two links 60 for moving the bowl seal from the closed position to the open position. Yoke 66 is actuated by a cable 68 comprising an inner stranded wire 70 that runs in an outer housing 72. Housing 72 extends between a fixed bracket 74 on bowl 24 adjacent yoke 66, and fixed bracket 76 inside molding 20 (see also FIG. 3). The inner wire 70 is attached at one end to yoke 66 and at the opposite end to linkage 38 (FIG. 3) as will be described.

A similar cable 77 comprising an inner stranded wire 78 and an outer housing 80 also extends between linkage 38 and the water valve 52 (FIG. 2). Again, the outer cable extends between two fixed brackets 82 and 84 in the inner wire 78 is actually coupled to the linkage 38 and to water valve 52. Again, details of the water valve are given in the '988 patent referred to previously.

The two cables or wires 70 or 78 provide elongate operating elements that extend between the linkage 38 and the ball seal and water supply valve respectively.

Figure 3:
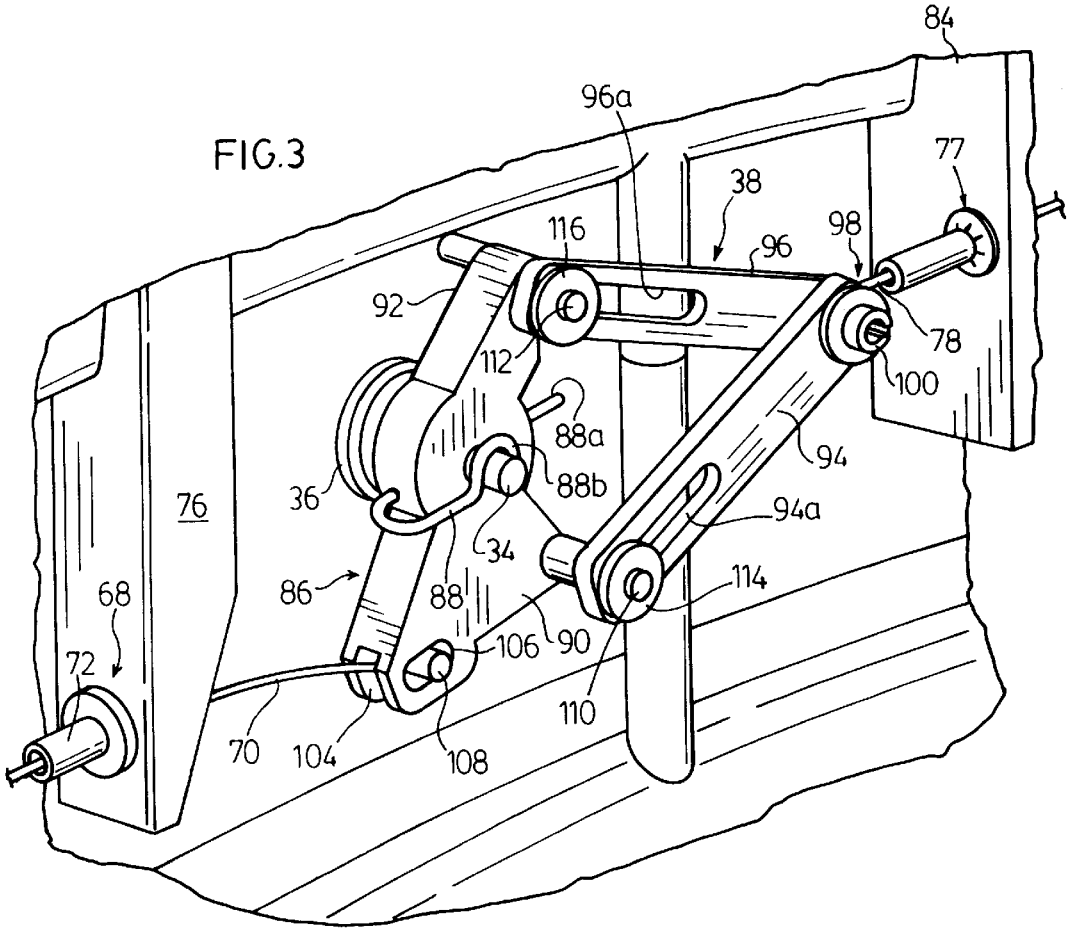
FIG. 3 is a perspective view of a linkage of the flushing mechanism of the)toilet, as seen from the interior of the toilet housing.

Referring now to FIGS. 3 and 4, it will be seen that the linkage 38 includes a primary lever element 86 that is carried by the pivot shaft 34 for the operating lever 28. As seen in FIG. 4, lever 28 and the lever element 86 are in their normal rest positions. Reference numeral 88 denotes a retainer clip having a limb 88*a* that extends through aligned openings in shaft 34 and lever element 86, and a limb 88*b* that is looped around shaft 34.

Element 86 defines a pair of lever arms 90, 92 that extend generally in diametrally opposite directions from shaft 34. In the illustrated embodiment, the two arms 90 and 92 extend generally vertically from shaft 34. The two operating cables 68 and 77 extend laterally with respect to shaft 34, also in generally diametrally opposite directions, but horizontally.

Linkage 38 also includes a pair of links 94, 96, each pivotally coupled at one end to a distal region of one of the lever arms 90, 92. At their opposite ends, the links are pivotally coupled together at a common pivot point 98. A split cylindrical sleeve 100 extends through aligned openings in the two links 94 and 96. Fitted within sleeve 100 is a cylindrical end fitment 102 at the outer end of the inner wire 78 of the cable that connects to the water supply valve 52.

It will be appreciated that tension will be applied to cable 78 (opening the watering valve 52) irrespective of the direction in which the flush lever 28 is turned. In other words, the flush water valve can be opened by either depressing or raising lever 28.

The bottom lever arm 90 has the general shape of a triangle and has coupled thereto, the inner wire 70 of the cable 68 that connects to the bowl seal 58. As best seen in FIG. 3, wire 70 extends through a bracket 76 on the toilet housing and into a slot 104 that is formed in lever arm 90 in a plane at right angles to the axis of pivot shaft 34. An elongate slot 106 is formed transversely with respect to slot 104 through the lever arm and receives a cylindrical end fitment 108 at the end of wire 70. Accordingly, if the flush lever 28 is depressed at its outer end so that lever element 86 turns in the counterclockwise direction as shown in FIG. 4, wire 70 will be placed under tension, moving the bowl seal to its open position as shown in FIG. 2. In other words, depression at the outer end of lever 28 will both open the water valve 52 and the bowl seal 58. However, if the outer end of lever 28 is raised, while water valve 52 will be opened, the bowl seal 58 will remain closed. The user of the toilet therefore has the option to fully flush the toilet by depressing lever 28, or to simply rinse the bowl by raising the lever.

In the event of a partial failure of linkage 38 the lever can still be operated to at least rinse the bowl. For example, if link 94 or pin 110 breaks, the lever can still be turned in the counter-clockwise direction (a) to rinse the bowl as well as flush the bowl and open the bowl seal. In this case, only the ability to add water through movement operation of the lever in a clockwise direction (b) becomes disabled. If link 96, arm 92 or pin 112 breaks, the lever can still be turned in the counter-clockwise (a) direction to flush the bowl and open the bowl seal, and turned in the clockwise direction (b) to add water to and rinse the bowl.

Figure 5:
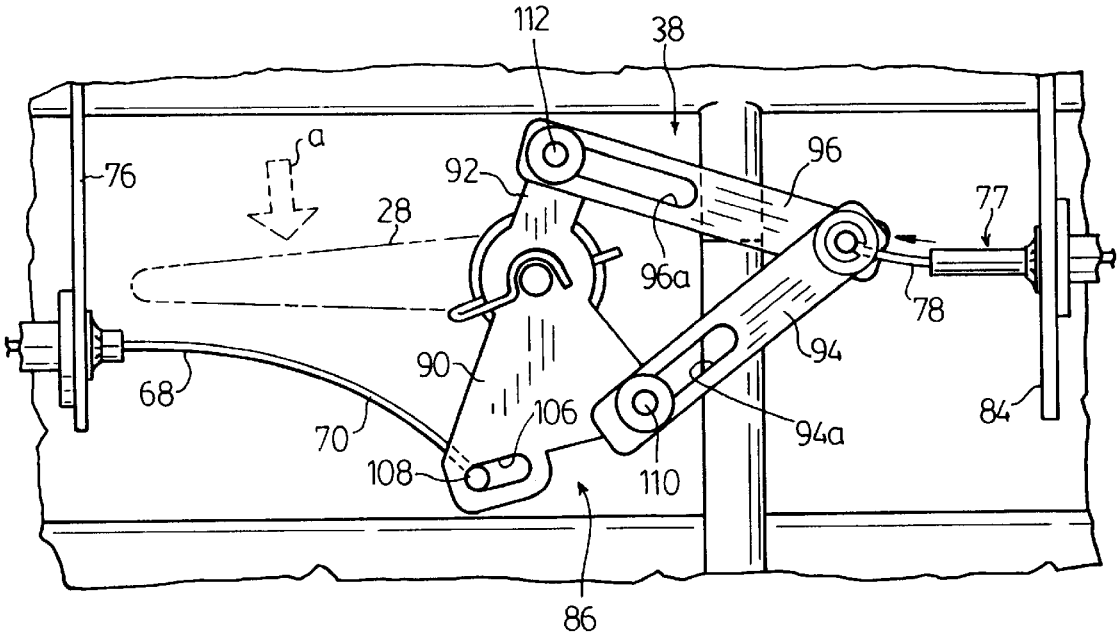
FIGS. 5 and 6 are sequential views similar to FIG. 4 illustrating normal flushing of the toilet by a depression of a flush lever; and, FIG. 7 is a view similar to FIG. 4, illustrating lifting of the flush lever to dispense water only.
Figure 6:
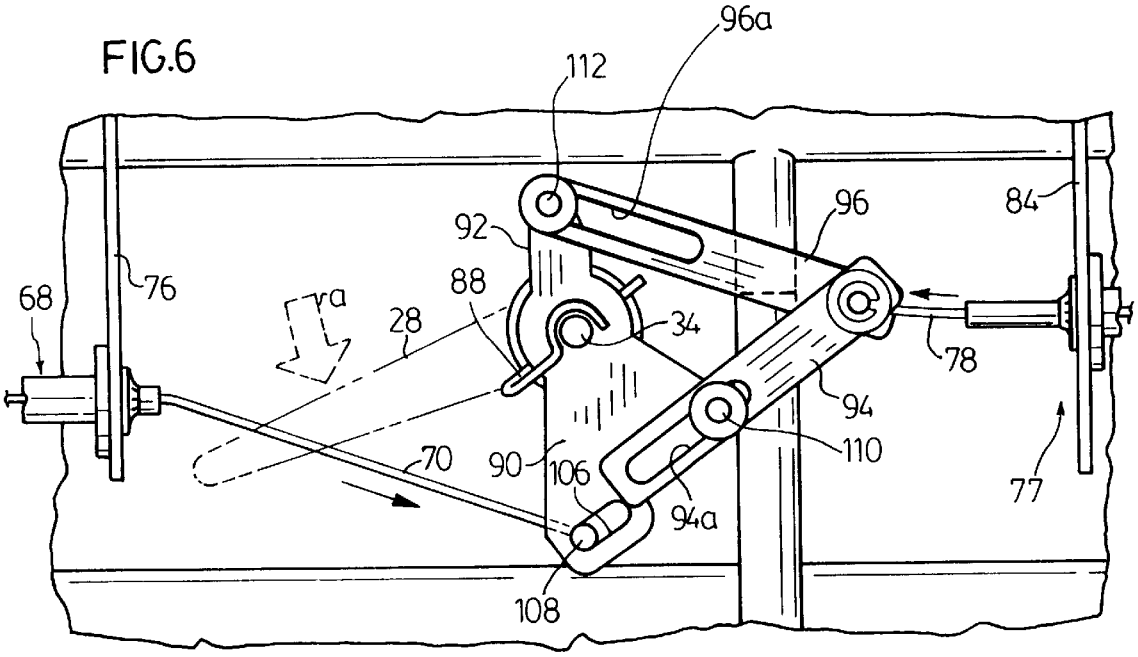

Referring now to FIGS. 5 and 6, specific events in the flush cycle and their sequence will now be described.

As noted previously, the transverse slot 106 through lever arm 90 is elongated (compared with the diameter of wire fitment 108). Also, the wire 70 is connected in assembling the toilet so that there is some slack in the wire when the flush lever 28 is in its normal rest position as shown in FIG. 4. Accordingly, there is some "lost motion" between lever element 86 and wire 70. When lever is initially depressed as indicated by the arrow "a" in FIG. 5, the first event that occurs is the tensioning of the wire 78 and opening of the flush valve 52 for rinsing the bowl of the toilet. Wire 70 is not initially tensioned so that the bowl seal is not opened until the lost motion is taken up.

It will be seen that the two links 94 and 96 also include elongate slots 94*a* and 96*a* respectively through which the links are coupled with the respective lever arms 90 and 92. As best seen in FIG. 3, this coupling is accomplished by respective pins 110 and 112 that extend outwardly from the lever arms through the slots 94*a* and 96*a* respectively. Washers 114 and 116 on the respective pins ensure retention of the links on the pins.

Reverting to FIGS. 5 and 6, it will be seen that, as the lever 28 is moved downwardly, the pin 110 on lever arm 90 moves up the slot 94*a* in link 94 and the link does not interfere with the generally rectilinear "pull" that is exerted on wire 78 by link 96. FIG. 6 also shows that continued depression of lever 28 eventually causes the slack to be taken up in wire 70 with the result that that wire is placed under tension, opening the bowl seal.

Figure 7:
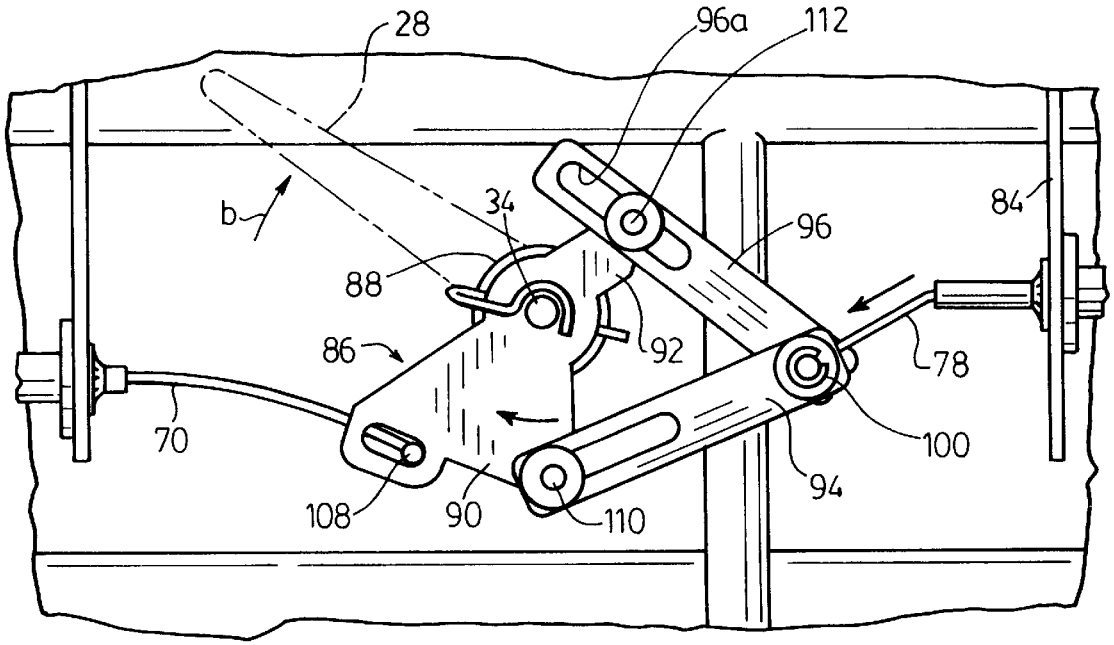

FIG. 7 shows flush lever 28 as having been lifted at its outer end. In this case, cable 78 is still placed under tension, but this time through link 94. The pin 112 on lever arm 92 moves down slot 96*a* in link 96, again so as not to interfere with the pulling action exerted on wire 78.

FIG. 7 also shows that no pull is exerted on wire 70. The end fitment 108 on the wire moves to the end of slot 106 closest to pivot pin 110 and the wire simply adopts a slack state.

In summary, the linkage shown in FIGS. 3 to 7 allows the user to flush the toilet in the normal manner by simply depressing handle 28. The water valve 52 will open first, rinsing the bowl, followed by opening of the bowl seal 58 and flushing of the toilet. When the handle 28 is released, spring 64 (FIG. 2) will close the bowl seal first. Wire 78 will remain under tension for a short time as the lever 28 returns to its rest position, so that water will continue to rinse down the surface of the bowl until the lever 28 returns to its rest position. Though not shown in the drawings, the water valve has a return spring that will not only close the valve but also return lever arm 28 to its rest position. If the user wishes to simply add water to the bowl or rinse down the bowl, the lever 28 can be raised as shown in FIG. 7. In any event, should a failure occur within linkage 38 (other than a complete catastrophic failure of the whole linkage), the linkage can still be operated by lever 28 to rinse down the bowl.

It will of course be appreciated that the preceding description relates to a particular preferred embodiment of the invention only and that many modifications are possible within the broad scope of the invention. For example, an actuator other than a lever pivoted at one end could be used, e.g., a two-armed lever or an operating wheel or the like. Where a simple pivoted lever is used, the normal rest position of the lever could be vertical rather than horizonal.

Elongate operating elements other than cables comprising an inner wire within an outer housing could be used, for example, wire and pulley arrangements.

The precise design and configuration of the linkage 86 may of course also vary. For example, both of the cables 68 and 77 could extend in the same direction from the linkage 86 (e.g. to the right in FIG. 4—in which case, cable 70 would be connected to the upper lever arm 92). Another possibility is for the two lever arms 90 and 92 to extend horizontally from shaft 34 and both cables to extend downwardly from the linkage.

I claim:

1. A toilet comprising:

a housing which includes a bowl for receiving waste, the bowl having an outlet;

bowl closure means normally closing said outlet and operable to open the outlet for discharge of waste from the bowl;

water supply means operable to deliver water into the bowl;

flush means comprising: an actuator pivotally mounted externally on the housing; and means coupling the actuator to the bowl closure means and to the water supply means for operating the same, the actuator being turnable about a pivot axis selectively in opposite directions (a) for operating both the water supply means and the bowl closure means, or (b) for operating the water supply means only; said coupling means comprising a pivot shaft defining said pivot axis, the shaft extending through said housing and, the actuator being coupled to the shaft externally of the housing for turning the shaft; a linkage mounted on said shaft within the housing so as to be turned by the actuator; first and second elongate operating elements extending respectively between the linkage and the water supply means and between the linkage and the bowl closure means, and arranged when placed under tension to operate the respective means, wherein the linkage is adapted to place both operating elements under tension when the actuator is turned in said direction (a), and when the actuator is turned in said direction (b) to place under tension only said operating element extending to said water supply means.

2. A toilet as claimed in claim 1, wherein said linkage comprises a primary lever element coupled to said pivot shaft and defining a pair of lever arms extending generally in diametrally opposite directions from said shaft, and a pair of links each pivotally coupled at one end to a distal region of a respective one of the lever arms, the links being pivotally coupled together at their respectively opposite ends at a common pivot point, wherein said first elongate operating element is coupled to said common pivot point so as to be tensioned when the actuator is turned in direction (a) or in direction (b), and wherein said second elongate operating element is coupled to the respective one of said lever arms as to place the second operating element under tension when the actuator is turned only in direction (a).

3. A toilet as claimed in claim 2, wherein said actuator is a flush lever mounted at one end on said pivot shaft, at a location on said housing selected so that the lever is readily accessible to a person seated on the toilet, said lever having a generally horizontal rest position, said movement in direction (a) being downward movement of the lever, and said movement in direction (b) being upward movement of the lever.

4. A toilet as claimed in claim 3, wherein said lever arms of the primary lever element extend generally vertically with respect to said pivot shaft, and wherein said first and second elongate operating elements extend between said linkage and the respective water supply means and bowl closure means, said second operating element being connected to a downwardly extending one of said pair of lever arms.

5. A toilet as claimed in claim 4, wherein said second elongate operating element is coupled to said downwardly extending lever arm by coupling means providing lost motion between said lever arm and said operating element, so that, upon movement of said actuator in direction (a), the bowl closure means does not open until after the water supply means has been operated to deliver water into the bowl and, upon release of said actuator, the bowl closure means closes before termination of water delivery to the bowl.

6. A toilet as claimed in claim 4, wherein said elongate operating elements comprise respective cables each comprising an inner wire and an outer housing, said outer housings extending to respective brackets on opposite sides of said linkage, and the wires of the respective cables extending through said brackets to said lever arms.

7. A toilet as claimed in claim 2, wherein each said link is pivotally coupled to the respective said lever arm by a pivot pin that extends through an elongate slot in the respective link to create lost motion so that, when said actuator is turned in direction (b) for moving a first one of said links, the pivot pin for the other link is free to travel along its respective slot without affecting tensioning of said first elongate operating element.

* * * * *